United States Patent [19]

Joscelyn et al.

[11] 4,379,211

[45] Apr. 5, 1983

[54] ARCUATELY TENSIONED PIEZOELECTRIC DIAPHRAGM MICROPHONE

[75] Inventors: Edwin Joscelyn, Commack; Michael J. Ferrante, Bayshore; Robert F. Saiya, North Babylon, all of N.Y.

[73] Assignee: Telephonics Corporation, Huntington, N.Y.

[21] Appl. No.: 196,528

[22] Filed: Oct. 14, 1980

[51] Int. Cl.[3] ..... H04R 17/02

[52] U.S. Cl. ..... 179/110 A

[58] Field of Search ..... 179/110 A

[56] References Cited

FOREIGN PATENT DOCUMENTS 2911917 10/1980 Fed. Rep. of Germany ... 179/110 A 6801923 8/1969 Netherlands ..... 179/110 A

*Primary Examiner*—George G. Stellar

*Attorney, Agent, or Firm*—Wolder, Gross & Yavner

[57] ABSTRACT

A lightweight piezoelectric microphone using a metallized piezoelectric diaphragm arcuately bowed by a boss on a slotted baffle plate held in close parallel proximity to the diaphragm is disclosed. Slotted Helmholtz resonators provide frequency response shaping and wide band noise cancellation. Electrical contact between the diaphragm and an electrical conductor is provided by a conductive, elastic material compressed by parts of the microphone housing, into electrical contact with the conductor and a metallized side of the diaphragm.

11 Claims, 4 Drawing Figures

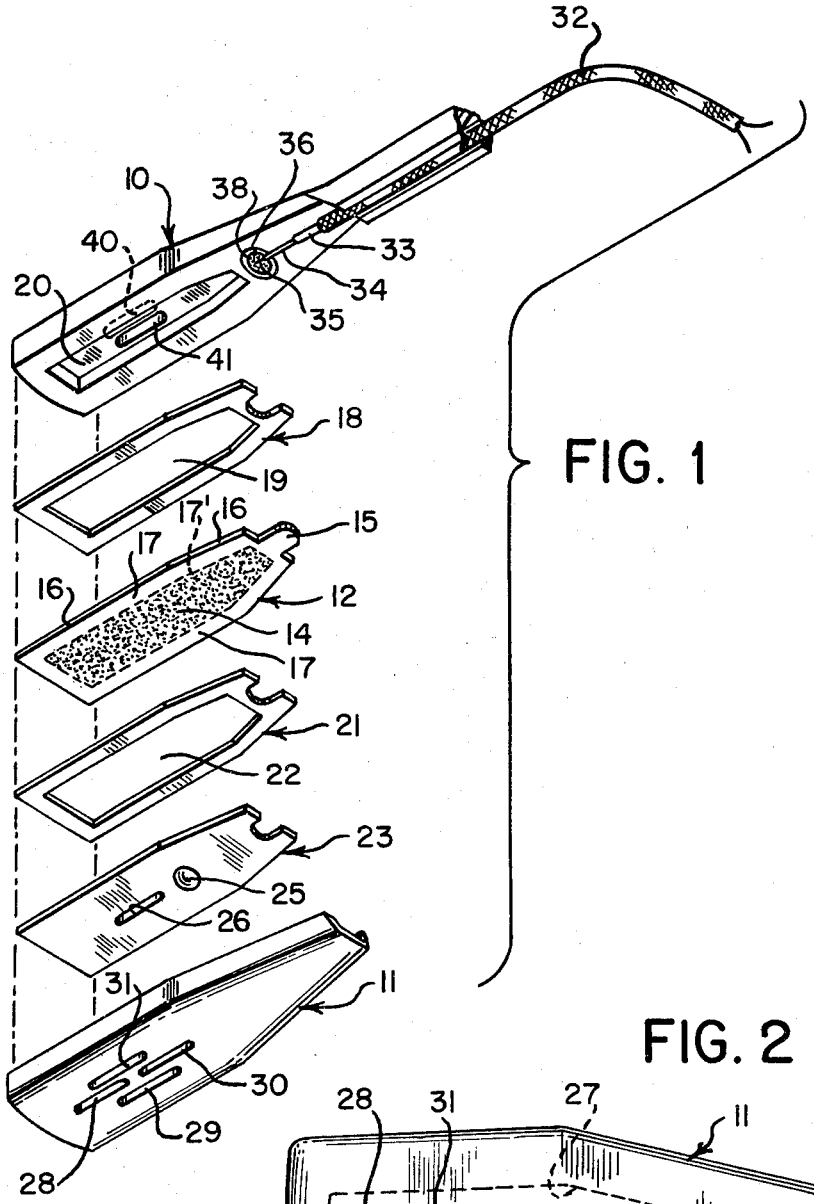
FIG. 1
FIG. 2
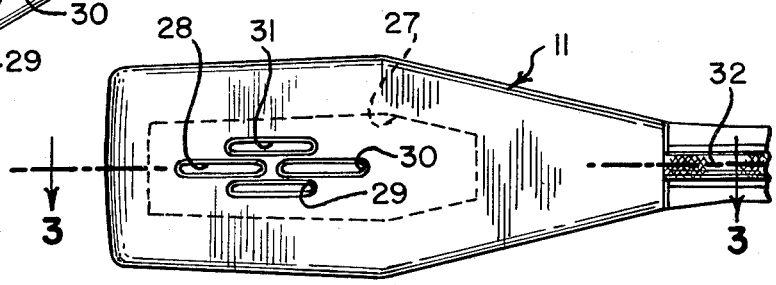

ARCUATELY TENSIONED PIEZOELECTRIC DIAPHRAGM MICROPHONE

TECHNICAL FIELD

This invention relates to piezoelectric acousto-electric transducers and particularly to piezoelectric microphones employing plastic sheet piezoelectric diaphragms, generally composed of piezoelectric polymers.

To efficiently utilize such a piezoelectric diaphragm it it necessary to put the diaphragm in tension while arching it. The characteristics of the microphone will vary with changes in the properties of backing materials used to arch and tension the diaphragm.

BACKGROUND ART

The discovery of the piezoelectric properties of certain polymers has been exploited by many individuals to produce acoustic to electric or electric to acoustic transducers and other devices with related principles of operation.

U.S. Pat. No. 3,982,143 to Tamura et al. disclose a piezoelectric electro-acoustic transducer which includes a piezoelectric diaphragm backed by a resilient material such as a polyurethane foam. U.S. Pat. No. 4,008,408 to Kodama, U.S. Pat. Nos. 3,973,150, 3,976,897, and 3,997,804 to Tamura et al., U.S. Pat. No. 4,024,355 to Takashasti and U.S. Pat. No. 4,045,695 to Itagaki et al. disclose improvements in this concept.

U.S. Pat. No. 3,792,204 to Murayama discloses a peripherally supported, curved diaphragm vibrated by both piezoelectric and electrostatic principles, of a shape which may be that of a resonance body of a string music instrument.

Piezoelectric transducers utilizing resilient diaphragm backings are subject to change in properties such as sensitivity or frequency response as the backing changes resiliency with time or due to changes in environmental conditions such as temperature or humidity.

"Molded Piezoelectric Transducers Using Polar Polymers", by Micheron and Lemmon in the *Journal of the Acoustical Society of America*, Volume 64, No. 6 (December, 1978), page 1720 discloses piezoelectric films which are self shaped, requiring no backing to impart curvature. While not having the disadvantages of resiliently backed diaphragm transducers outlined above, these transducer diaphragms are subject to collapse when handled in a rough manner.

"Piezoelectric and Pyroelectric Polymer Sensors" by Seymour Edelman in *Report on Sensor Technology for Battlefield and Physical Security Application Mobility Equipment*, Research and Development Command, Fort Belvoir, Va., July 1977, at page 209 indicates that "the thinness of the polymer sheet permits it to be used as the active material in a light weight noise-cancelling microphone which responds well to a nearby source such as a speaker's lips while minimizing the effect of ambient noise."

U.S. Pat. No. 3,168,934 to Wilson discloses a microphone which is noise cancelling as a result of an inlet port near a speaker's mouth and an inlet port away from a speaker's mouth being connected by ducts of equal lengths to opposite sides of a diaphragm. This structure generally results in noise cancellation over a limited frequency range and some loss of sensitivity.

"Piezoelectric Polymer Transducers for Dynamic Pressure Measurements," by DeReggi et al, National Bureau of Standard Publications NBSIR 76-1078, June, 1976 at page 5 and in Appendix D, p 34–38, discloses the use of silver bearing rubber paint to make contact to a metal plating on a piezoelectric polymer film, and the disadvantages of the technique.

U.S. Pat. No. 3,970,862 to Edelman, et al. discloses the use of a silver epoxy dot to make electrical contact with the "hot" or ungrounded metallized surface on a piezoelectric polymer film.

The theory of design and application of resonant cavities is well known. Helmholtz resonators have been used in a variety of acoustic devices. A simplified design theory was reported by Lord Rayleigh in Volume II of *The Theory of Sound*, published by Macmillan and Co. in 1896 and is referred to in *Modern Acoustics* by A. H. Davis, published by Macmillan Company in 1934 at page 119 et seq. and is also discussed in *A Handbook of Sound*, by A. B. Wood, published by Macmillan Company in 1955.

"Electroacoustic Transducers Using Piezoelectric Polyvinylidenefluoride Films", by Reinhard Lerch, in the *Journal of the Acoustical Society of America*, Volume 66, No. 4, (October, 1979) at page 952 discloses the results of the computation of the sensitivity and lowest frequency of resonance as a function of the radius of curvature of dome shaped diaphragms.

DISCLOSURE OF INVENTION

The present invention overcomes certain difficulties of prior art devices by use of a piezoelectric diaphragm supported at its periphery and arched into tension by a boss on a baffle plate in close parallel proximity to the diaphragm.

A slot is provided in the baffle plate, and a small volume between the baffle plate and the diaphragm serves as one of three resonators which aid in establishing the microphone frequency response.

The diaphragm and baffle plate are preferably secured between a microphone support base, or boom, and a rear cover. This construction defines two additional volumes, one between the baffle plate and the rear cover, and another between the support base and the diaphragm. These volumes advantageously function as resonators.

The front support base, upon which the sound energy which is to be converted to electrical energy impinges, and the rear cover are slotted. The geometry of these slots and the size of the defined volumes characterize the frequency response of the resonators formed, thus further defining the frequency response of the microphone.

Noise cancellation results from the fact that slots which allow acoustic energy to impinge on both sides of the diaphragm are disposed on both the front and back of the microphone, which is a thin structure.

An electrical connection between a metallized side of the diaphragm and an electrical conductor is provided within the microphone housing. The housing is formed from two mating nonconductive parts. A volume is defined by cavities in the housing parts adapted to receive the electrical conductor. A portion of the volume is adapted to receive a portion of the metallized film. An elastic conductive material in that portion of the volume is compressed by the mating of the housing parts into electrical contact with the conductor and the metallized side of the metallized film.

In one embodiment the metallized film and the electrical conductor are held in contact between the compressed material and one of the housing parts. In another embodiment the electrical conductor is encapsulated in a quantity of the conductive elastic material which may cure in place prior to assembly, and the metallized film is held between the compressed material and one of the housing parts.

BRIEF DESCRIPTION OF DRAWINGS

Further objects and advantages of the invention may be readily ascertained by reference to the following description and appended drawings.

FIG. 1 is an exploded view illustrating the components of a preferred embodiment the microphone;

FIG. 2 is a bottom plan view of the assembly of FIG. 1.

FIG. 3A is a cross section of an alternate embodiment of the electrical connection means illustrated in FIG. 3.

In the drawings and the following descriptions, like portions or parts are identified by like reference numerals.

BEST MODE FOR CARRYING OUT THE INVENTION

Figure 3:
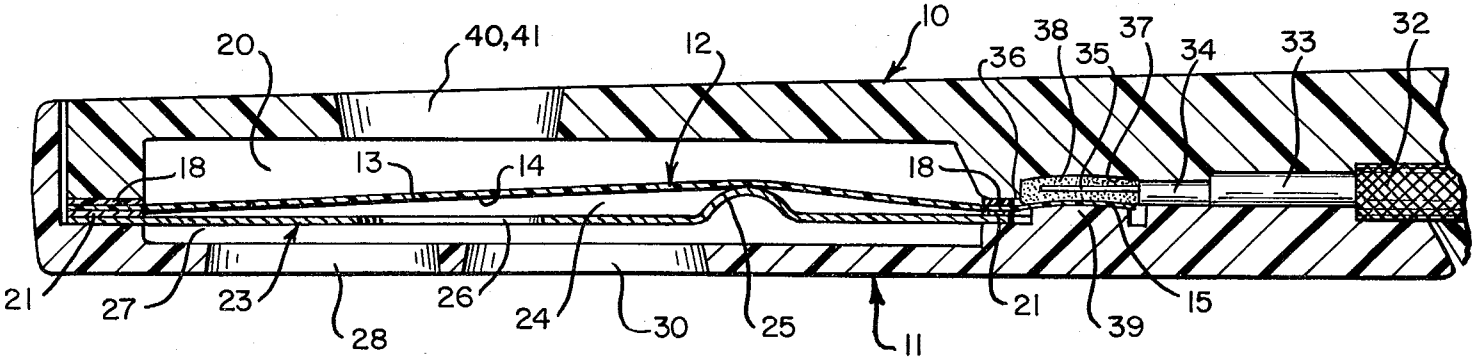
FIGS. 3 and 3A are cross sections of the assembled microphone of FIG. 2 taken generally along the line 3—3.

Referring to FIGS. 1 and 3, the internal parts of the assembled microphone or acousto-electric transducer are housed by a support base 10, and a back cover 11 which serve to peripherally support the internal parts in generally a flat plane. Support base 10 and cover 11 are advantageously formed by molding a flexible plastic capable of withstanding severe mechanical abuse without rupture, such as a polyamide, for example nylon TROGAMID T manufactured by Kay-Treies, Inc. of Montvale, N.J., a division of Dynamit Nobel of America.

The internal parts include a metallized piezoelectric diaphragm 12 which in the illustrated embodiment is generally of rectangular dimensions of approximately 0.890 inches by 0.275 inches, but which could if desired be of different shape or dimensions. Diaphragm 12 is a thin film piezoelectric polymer, preferably polyvinylidenefluoride (hereinafter referred to as $PVF_2$). The $PVF_2$ film is polarized to obtain piezoelectric properties by heating and applying a strong electric field across its thickness which is preferably about thirty microns with a value of the piezoelectric constant $d_{33}$ greater than $20\times10^{-12}$ Coulombs/Newton. Such diaphragms are well known in the prior art.

Diaphragm 12 is plated with a metal or metal alloy such as nickel-chromium coating which has a resistivity of about 200 ohms per square inch. Nickel is preferred because of its relatively good adherence to the surface of the $PVF_2$ diaphragm and because of its ability to withstand adverse environmental conditions. The diaphragm surfaces are metallized to provide electrodes which sense the electrical charge produced by the piezoelectric diaphragm and to afford output connection to appropriate electrical signal conductors.

Preferably the metallic plating on the diaphragm 12 is applied to both sides (with the exception of a small limited area) thus defining a hot electrode 13 on the top side of the diaphragm 12 and a ground electrode 14 on the bottom side thereof. Neither the edge 16 nor the peripheral area 17 on the top side of the diaphragm 12 are plated. The peripheral area 17 is represented by the distance between the dotted line 17′ and the edge 16 of diaphragm 12. The bottom of the diaphragm 12 is plated except in the area of tab 15.

The lack of plating on diaphragm 12 in the area 17 enhances the dielectric breakdown voltage of the diaphragm. If the plating were simply to extend to the edge 16, then only a small air gap would prevent dielectric breakdown and consequent shorting of the transducer.

A nonconductive glue ring 18 with a cut out area 19 preferably similar in shape to the diaphragm 12 through which sound travels to vibrate the diaphragm 12, serves several functions. It attaches the diaphragm 12 to the support base 10, further providing improved dielectric properties by acting as an insulator filling the space adjacent to the nonmetallized area 17 of the diaphragm 12. It also acts as an acoustic seal, confining sound to a front resonator volume defined by a cavity 20 (which is approximately 0.850 inches long by 0.280 inches wide, and 0.078 inches high) in the support base 10, and the diaphragm 12. It further serves to insulate the hot electrode 13, from the support base 10 which is preferably coated with an electrically conductive material to help shield the assembly from electrical interference.

The nonconductive glue ring 18 is comprised of a polyester base, preferably Mylar, approximately 0.0075 inches thick which is coated with a pressure sensitive acrylic adhesive on each side to a thickness of approximately 0.0005 inches. This structure provides a thick rigid Mylar base and thin glue line, which has good shear strength and which holds the diaphragm securely at its periphery.

Assembled to the underside of the diaphragm 12 is a conductive glue ring 21. This glue ring is comprised of copper with a thickness of approximately 0.002 inches, coated with a pressure sensitive acrylic adhesive to which fine metal particles have been added to impart electrical conductivity to the adhesive. Sound vibration pass through opening 22 in the conductive glue ring 21.

Conductive glue ring 21 also serves to support baffle plate 23, in parallel proximity to diaphragm 12. Glue ring 21 serves as an electrical conductor making electrical contact between the ground electrode 14 of the diaphragm 12, and baffle plate 23. It also acts as an acoustic seal defining a volume of space 24 between diaphragm 12 and baffle plate 23. Volume 24 as shown in FIG. 3 is larger than might be expected because of the action of a small dome, preferably a boss 25 in the baffle plate 23 which serves to bow and tension the diaphragm 12 away from the baffle plate 23. Volume 24 actively functions as an acoustic Helmholtz resonator of the type without a "neck".

Curvature of the diaphragm 12 is necessary if the sound vibrations are to be efficiently and linearly converted to electrical signals. Inefficient conversion and signal frequency doubling takes place if the diaphragm 12 is not bowed and taut.

Boss 25 and the baffle plate 23 thus form a rigid structure which arcuately tensions the diaphragm 12. The baffle plate is formed preferably of 0.007 inch thick aluminium alloy 5052-H32. The rigidity of the structure is stable with time, and varying environmental conditions, a feature not present with resiliently backed diaphragms. This results in stability of electrical properties such as frequency response and sensitivity, as a function of time and changing environmental conditions. While relative stability could also be obtained with molded, self supporting shaped piezoelectric diaphragms, these structures are subject to collapse with rough handling. The rigidly backed structure provided by the present invention is both stable and rugged, and yet light in weight.

In a preferred embodiment it has been found that the optimuim height for the boss 25 is about 0.012 inches above the surface of the baffle plate 23. and the dome of the boss has a radius of curvature of approximately 0.125 inch. The arched tension provided in the piezoelectric diaphragm by the above described baffle boss produces excellent transducer sensitivity and frequency response.

Baffle plate 23 advantageously contains a slot 26 which allows sound energy to be coupled between volume 24 and a cavity 27 defined by baffle plate 23 and cover 11. Volume 24 functions as a resonant cavity having a resonant frequency defined by the magnitude of volume 24 and by the length of slot 26. In a preferred embodiment, slot 26 is approximately 0.250 inches long by 0.015 inches wide which affords an enhanced transducer output over a frequency range of about 1500 Hz to 2100 Hz.

Volume 24 exchanges sound energy with cavity 27 which functions as a neck type Helmholtz resonator, typical dimensions being 0.850 inches long, 0.280 inches wide, and 0.024 inches high. The volume of the cavity 27, the length of the slots 28, 29, 30, and 31, and the thickness of the cover in the vicinity of slots 28, 29, 30 and 31, which comprise the length of the neck of the resonator, determine the resonant frequency of the resonator cavity 27. In a preferred embodiment, slots 28, 29, 30, and 31 are approximately 0.035 inches wide by 0.230 inches long on the outside of the cover, and 0.015 inches by 0.210 inches where opening on the cavity 27, and are arranged as shown in FIG. 1. The latter resonator and the resonator defined by cavity 20 produces an increased signal output, or sensitivity, over a frequency range of about 3 KHz to 5 KHz, and a decreased output in the frequency range of about 2200 to 2600 Hz.

Cover 11 is assembled to the support base 10. This is accomplished by suitable molding of mating protrusions and slots, not shown, in the cover 11 and support base 10, allowing these two parts to mechanically snap together. The use of close tolerance plastic components to produce this type of assembly is well known. Assembly of the cover 11 to the support base 10 also serves to help tightly secure the internal parts by peripheral clamping.

Cover 11 is advantageously coated internally with an electrically conductive material. Since the support base 10 is also so coated, assembly of the cover 11 to the support base 10, provides an electrical connection to the ground electrode 14 of the diaphragm 12 through the conductive glue ring 21 and the baffle plate 23. Thus cover 11 also serves as a shield against electromagnetic interference.

A coaxial signal cable 32, prepared so that its ground or outer conductor 33, dielectric 34, and center conductor 35 are exposed, is trapped in suitable connected cavities, between support base 10 and cover 11. The outer conductor 33 makes contact with the conductive coating of support base 10 and the cover 11, and thus is in electrical contact with ground electrode 14 of diaphragm 12. A circular small area 36 is provided on the support base 10 which is free of conductive coating. A cavity 37, with a concave bottom is provided in the support base 10 located centrally within area 36, which is free of conductive coating. Before the internal parts are assembled to the support base 10, the coaxial cable 32 is placed in position as shown, and the center conductor is encapsulated within a conductive elastic material 38 such as a silver loaded rubber which cures in place. Care must be taken that shorting does not occur because of excess material 38 placed in the cavity which could short to the conductive coating of the base 10. Material 38 affords an electrical contact between the center conductor 35 of the coaxial cable 32 to the hot electrode 13 of the diaphragm 12, when the diaphragm 12 and other internal parts are assembled to the support base 10. A cylindrical protrusion 39, with a dome shaped top, of the cover 11 serves to push tab 15 of diaphragm 12 into intimate mechanical contact with the elastic material 38, thus assuring intimate electrical contact. Since the side of tab 15 in contact with protrusion 39 is not metallized and therefore not part of the ground electrode 14 of the diaphragm 12, there is no danger of electrical shorting at the tab.

In operation, sound waves from a speaker's lips enter the microphone through two slots 40 and 41 in support base 10. These slots are approximately 0.180 inch long and 0.040 inch wide at the outside of the microphone and 0.140 inch long by 0.020 inch wide at the entrance to cavity 20. As is the case for cavity 27, the slots 40 and 41 and cavity 20 comprise a Helmholtz resonator (of the variety with a neck) whose resonant frequency is determined by the volume of the cavity 20, the length and total area of slots 40 and 41, and their dimension through the support base, or length of the neck, which is approximately 0.030 inch in the described embodiment.

Diaphragm 12 is vibrated by the sound energy in cavity 20, which further aids in shaping the microphone frequency response. Further shaping of the frequency response is provided by resonator volmumes 24 and 27 as described above. The use of the three Helmholtz resonators tailors the frequency response. In particular the Helmholtz resonator comprised of volume 24 and slot 26 is resonant at approximately 1800 Hz, thus serving to enhance mid-range frequency response.

It will be understood by those skilled in the art that it is also possible to design each of the three resonators to provide different frequency response characteristics. Alternatively the frequency response of the microphone may be appropriately modified by an audio amplifier having a desired frequency response characteristic. For example, for use in telephone circuits a sloping frequency response below 3000 Hz is desirable. This sloping frequency response can be achieved advantageously by the use of an audio amplifier associated with a conventional one stage resistor-capacitor high pass filter.

To use the present invention as a microphone in telephone circuits it is generally necessary to amplify the microphone output and provide suitable impedance matching to the telephone line. Thus it is necessary, in any event, to provide an audio amplifier in telephone applications. This audio amplifier is most advantageously a single integrated type circuit, and can be powered from direct current provided by the telephone line.

In accordance with a further feature of the invention, noise cancellation over a wide frequency range is provided as a result of slots 28, 29, 30 and 31 in cover 11 and the slots 40 and 41 in support base 10, being located on opposite sides of the housing structure, which may be typically 0.200 inch thick. Noise cancellation frequency characteristics can also be tailored by suitable modifications of the Helmholtz resonators described above.

ALTERNATE EMBODIMENT

Figure 3A:
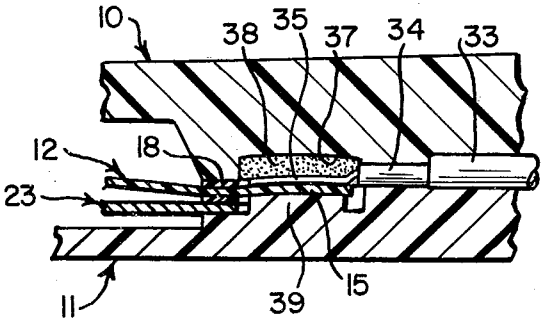

Referring to FIG. 3A, an alternate embodiment of a means for making an electrical connection from center conductor 35 to diaphragm 12 is illustrated. Material 38, also elastic and conductive in this embodiment, is a preformed squat cylinder, preferably comprised of a silver loaded rubber, advantageously cut out from a sheet of such material. This preformed material is placed within cavity 37. Tab 15 of diaphragm 12 is placed over cylindrical protrusion 39, as in FIG. 3, but in this embodiment center conductor 35 is placed over tab 15 thus contacting its metallized side. When the housing is snapped together, material 38 is compressed forcing conductor 35 against tab 15 and providing an intimate mechanical and therefore excellent electrical contact. While it is possible to obtain electrical contact in this embodiment without material 38 being conductive, a more reliable contact is assured if material 38 is a conductor.

This alternate embodiment is advantageously used when it is undesirable to wait for material 38 to cure in place, as is generally necessary with the previously described embodiment.

Various modifications of the invention in addition to those shown and described herein will become apparent to those skilled in the art from the foregoing description and accompanying drawings.

We claim:

1. A piezoelectric acousto-electric transducer comprising:

(a) a peripherally supported, metallized piezoelectric diaphragm;

(b) a baffle plate in close parallel proximity to said piezoelectric diaphragm;

(c) a boss protruding from said baffle plate with sufficient height to arcuately tension said diaphragm away from said baffle plate; and (d) means for making electrical contact to the metallized piezoelectric diaphragm.

2. The piezoelectric acousto-electric transducer of claim 1 wherein the piezoelectric diaphragm is metallized with a nickel-chromium coating.

3. The piezoelectric acousto-electric transducer of claim 1 in which said baffle plate includes a slot through which acoustic energy can travel from a first volume defined by said metallized piezoelectric diaphragm and baffle plate to the side of said baffle plate opposite said diaphragm, said first volume defining an acoustic resonator, whereby the frequency response of the piezoelectric acousto-electric transducer is altered.

4. The piezoelectric acousto-electric transducer of claim 3 further comprising a slotted cover defining a second volume of space between said baffle plate and said cover, said second volume of space comprising a resonator to alter the frequency response characteristics of the piezoelectric acousto-electric transducer.

5. The piezoelectric acousto-electric transducer of claim 4 further comprising an electrically conductive glue ring disposed between said baffle plate and said piezoelectric diaphragm; an electrically nonconductive glue ring disposed between the diaphragm and a slotted support base; and upon which slotted support base, the nonconductive glue ring, metallized piezoelectric diaphragm, the conductive glue ring, the baffle plate, and the cover are respectively assembled.

6. The piezoelectric acousto-electric transducer of claim 5 wherein an area along the periphery of the piezoelectric diaphragm on the side of said diaphragm in contact with the nonconductive glue ring is bare of metallization.

7. The piezoelectric acousto-electric transducer of claim 5 wherein the piezoelectric diaphragm comprises a tab, metallized on only one side.

8. The piezoelectric acousto-electric transducer of claim 7 wherein said support base and said cover are shaped so as to define a volume between said support base and said cover for receiving said tab of said piezoelectric diaphragm and a conductive, elastic material within which an electrical lead may be encapsulated, and which conductive and elastic material is held in intimate contact with the metallized side of said tab of said metallized piezoelectric diaphragm.

9. The piezoelectric acousto-electric transducer of claim 5 wherein said slotted support base and said metallized piezoelectric diaphragm define a third volume, said third volume being an acoustic resonator, whereby the frequency response of said piezoelectric electro-acoustic transducer is altered.

10. The piezoelectric acousto-electric transducer of claim 9 wherein the dimensions of said slots in said cover, support base and baffle, the area of said slots, the volume of said first, second and third volumes, and the depth of said slots in said cover and support base are configured to provide noise cancellation over the audio frequency range of approximately 300 to 5000 Hz.

11. The piezoelectric acousto-electric transducer of claim 9 wherein the dimensions of said slots in said cover, support base and baffle, the area of said slots, the volume of said first, second and third volumes, and the depth of said slots in said cover and support base are configured to provide a generally uniform frequency response from approximately 300 Hz to 3000 Hz, with an increase in sensitivity between approximately 1500 Hz to 2100 Hz and a decrease in sensitivity between 2200 Hz and 2600 Hz.

* * * * *